US005997270A

United States Patent [19]

LaBonté

[11] Patent Number: 5,997,270

[45] Date of Patent: Dec. 7, 1999

[54] AUTOMATED TROWEL

[76] Inventor: Hubert LaBonté , Erl Etude et Recherche 394, St. Joseph Est, Levis, Canada, G6V 1G7

[21] Appl. No.: 08/939,708

[22] Filed: Sep. 29, 1997

[30] Foreign Application Priority Data

May 15, 1997 [CA] Canada ..... 2205114

[51] Int. Cl.[6] ..... E01C 11/22

[52] U.S. Cl. ..... 425/64; 404/98; 404/105; 425/190

[58] Field of Search ..... 425/63, 64, 185, 425/190, 470, 472; 249/158; 404/98, 105

[56] References Cited

U.S. PATENT DOCUMENTS

| | | | |
|---|---|---|---|
| 3,261,272 | 7/1966 | Jennings, Jr. | 425/64 |
| 4,013,375 | 3/1977 | Heaton | 404/98 |
| 4,984,932 | 1/1991 | Leone | 404/72 |
| 5,080,532 | 1/1992 | Merville et al. | 404/96 |
| 5,173,005 | 12/1992 | Henderson et al. | 404/98 |
| 5,354,189 | 10/1994 | McKinnon | 425/64 |
| 5,527,129 | 6/1996 | McKinnon | 425/64 |
| 5,533,888 | 7/1996 | Belarde | 425/64 |
| 5,662,431 | 9/1997 | Colvard | 404/98 |

FOREIGN PATENT DOCUMENTS

| | | |
|---|---|---|
| 2315577 | 1/1977 | France . |
| 2400084 | 3/1979 | France . |
| 2669949 | 6/1992 | France . |
| 2268773 | 1/1994 | United Kingdom . |

*Primary Examiner*—James P. Mackey

[57] ABSTRACT

A flexible automated trowel for sliding formwork machine allowing the finishing of a continuous trapezoidal wall of the type having one rectangular side and one side inclined towards the top or with two angular sides. A mold supporting the trowel comprises two straight sides, an enlarging setback originating from a formwork line. A driveway cutter proceeds from the enlarging setback in the direction of the slope of the angular wall. The cutter may have a concave face which is to be placed against a moldable face to produce a superior convex face to the continuous wall. Materials like concrete for curbs, gutters, driveway entrances may be continuously poured and necessitate little or no finishing touches.

5 Claims, 9 Drawing Sheets

AUTOMATED TROWEL

FIELD OF INVENTION

This invention is related to the field of trowels for sliding formwork machines, for curbs and gutters.

PRIOR ART

Some patents have attracted particularly our attention:

U.S. Pat. No. 5,533,888, Belarde, Jul. 9, 1996 that reveals a mold for continuously pouring concrete, by means of two half-forms and of one sidearm 150 FIG. 2A. This allows producing an outer textured surface. Although this system can make concrete barriers, it is not appropriate for driveway entries.

U.S. Pat. No. 4,984,932, Leone, Jan. 15, 1991 shows a mold with parallel walls and drive through means producing a movement both vertical and parallel. This system works with difficulty when the walls (38) are not vertical.

FR 2,400,084, Bouchet, Aug. 11, 1977 illustrates a double section to support electric pipes or the like. With this system one could obtain a driveway of the concrete height by modifying the rate of vibrations but could not produce a lowered convex shape.

FR 2,315,577, Selmer Jun. 24, 1975. Slip-former for columns. There is here a certain inclination in the column 5 but nothing for a concrete driveway.

FR 2,669,949, STMO, Jun. 5, 1992. The system has some adjustments with a piston, the system provides for the sustaining and the orientation of concrete segments.

GB 2,268,773, Stover Apr. 8, 1992. Upper part of a manual trowel allowing to polish concrete. The manual trowel may be mounted tilted on a machine.

OBJECTIVES AND ADVANTAGES

It is a general objective of the invention to provide a flexible automated trowel for a sliding formwork machine that allows the finishing of a concrete continuous wall, even if one side of the wall is inclined and not vertical. This finishing is also completed by an upper face, convex or straight, with one or two points.

More precisely to provide for a wall subject to a lowering, at a driveway entrance, a hollow recessed part in a mold, the recessed part being a continuation of an inclined wall, a driveway cutter being allowed to move along the inclination. The cutter may be provided with a contact face with a concave form adapted to produce an upper convex face to the continuous wall of the circuit, especially at the lowered region of the driveway entrance.

DRAWINGS

Relative to the drawings that illustrate an embodiment of the invention,

DESCRIPTION OF THE INVENTION

In the description that follows and in the accompanied drawings similar numbers send back to the identical parts in the varied figures.

Figure 1:
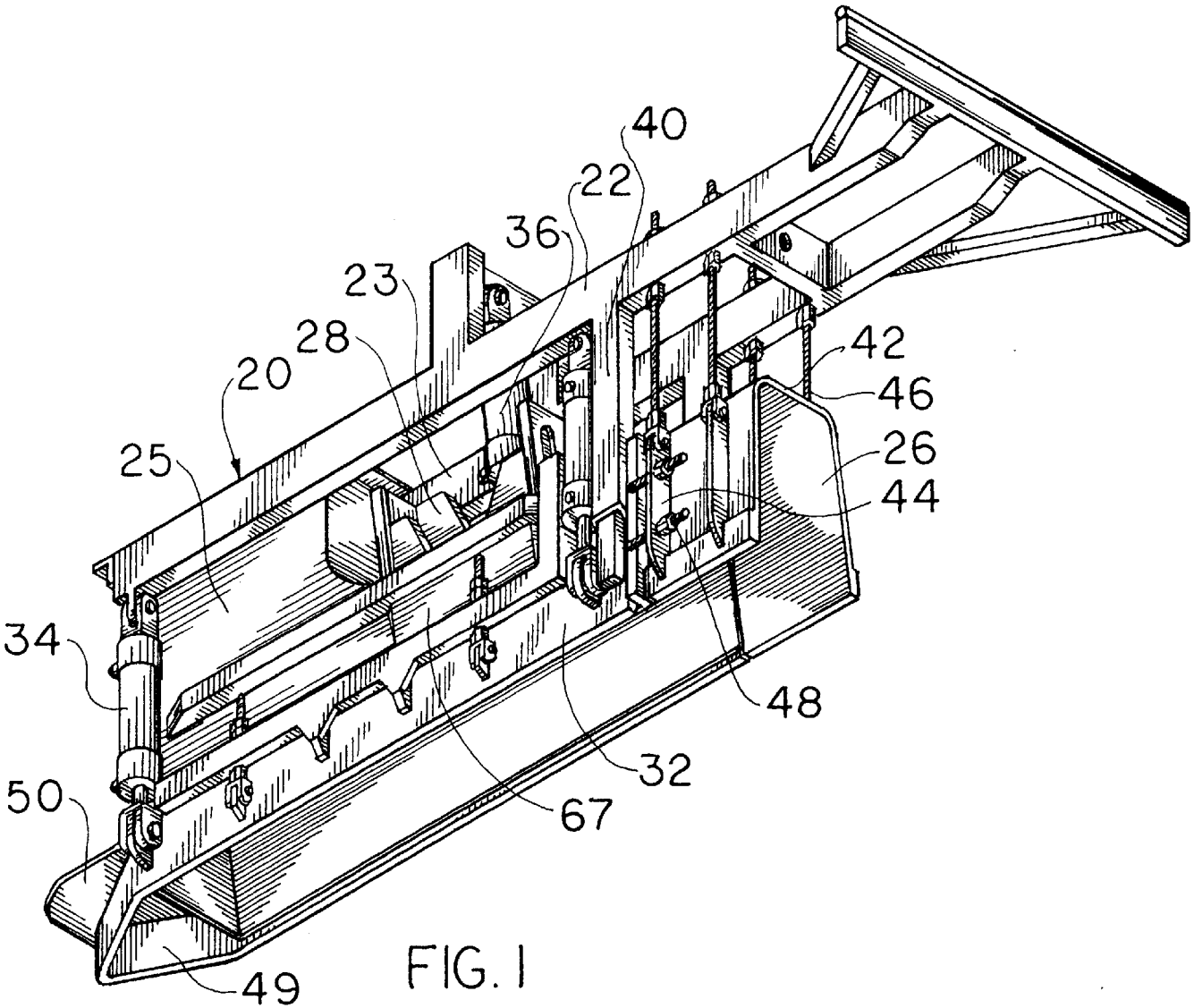
FIG. 1 is a perspective of a sliding mold seen from underneath

FIG. 1 shows a sliding mold 20 machine for curbs, in a perspective view taken from underneath, showing a mold frame 22 covering a trowel zone 23, a bin 25 and a finisher 26. One can see a penetration cutter in the trowel zone 23. A trowel cylinder 36 allows the displacement of a cutter 28. One also sees an extensible cutter 32 moved by the hydraulic of the cutter cylinders 34. A vertical reinforcement 40 serves as an adjustment grip for the finisher 26 and is attached to a finishing shell 42. A shell reinforcement 44 serves as grip to a vertical adjustment 46 and to an horizontal adjustment 48. At the front, a V-shaped plow 49 is covered by a protection pallet 50.

Figure 2:
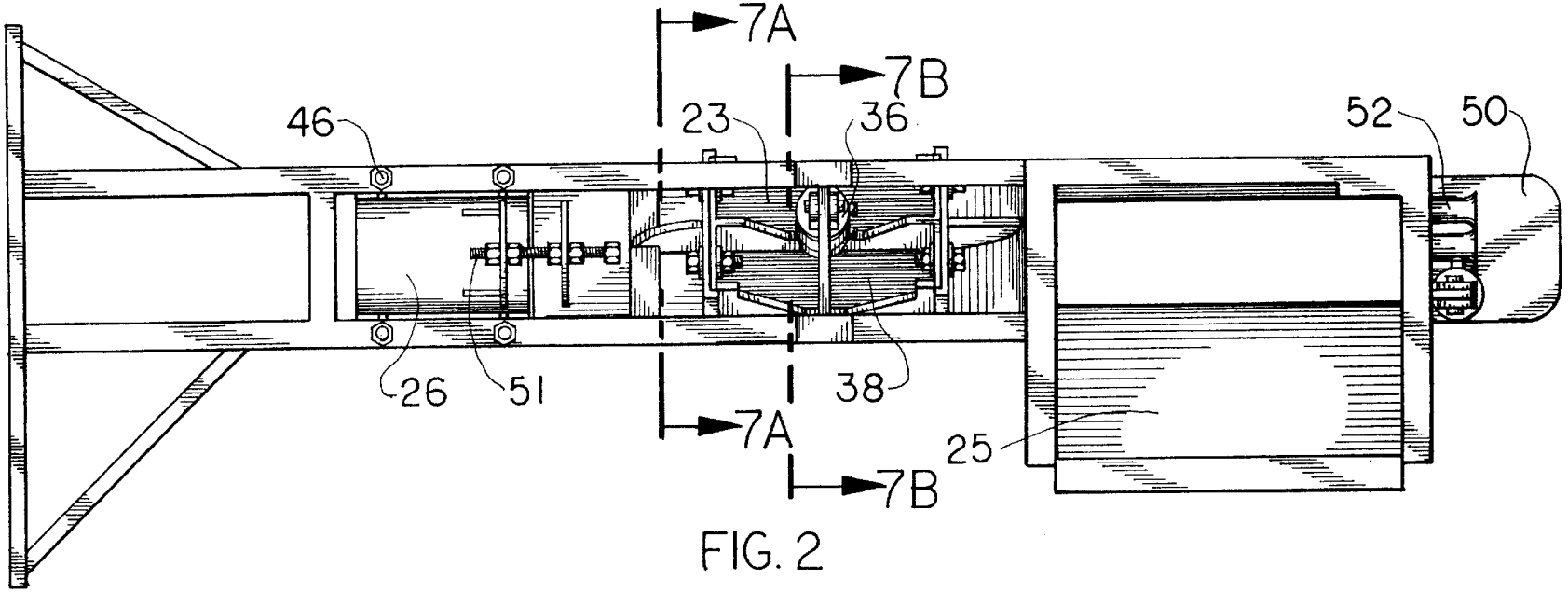
FIG. 2 is a top view of mold of FIG. 1, the front being on the right.

FIG. 2 shows, at the back, a tension adjuster 51 that orientates the finisher 26, in front of steel insertion tubes 52, and, in the trowel zone 23, a trowel 38 located under the trowel cylinder 36.

Figure 3:
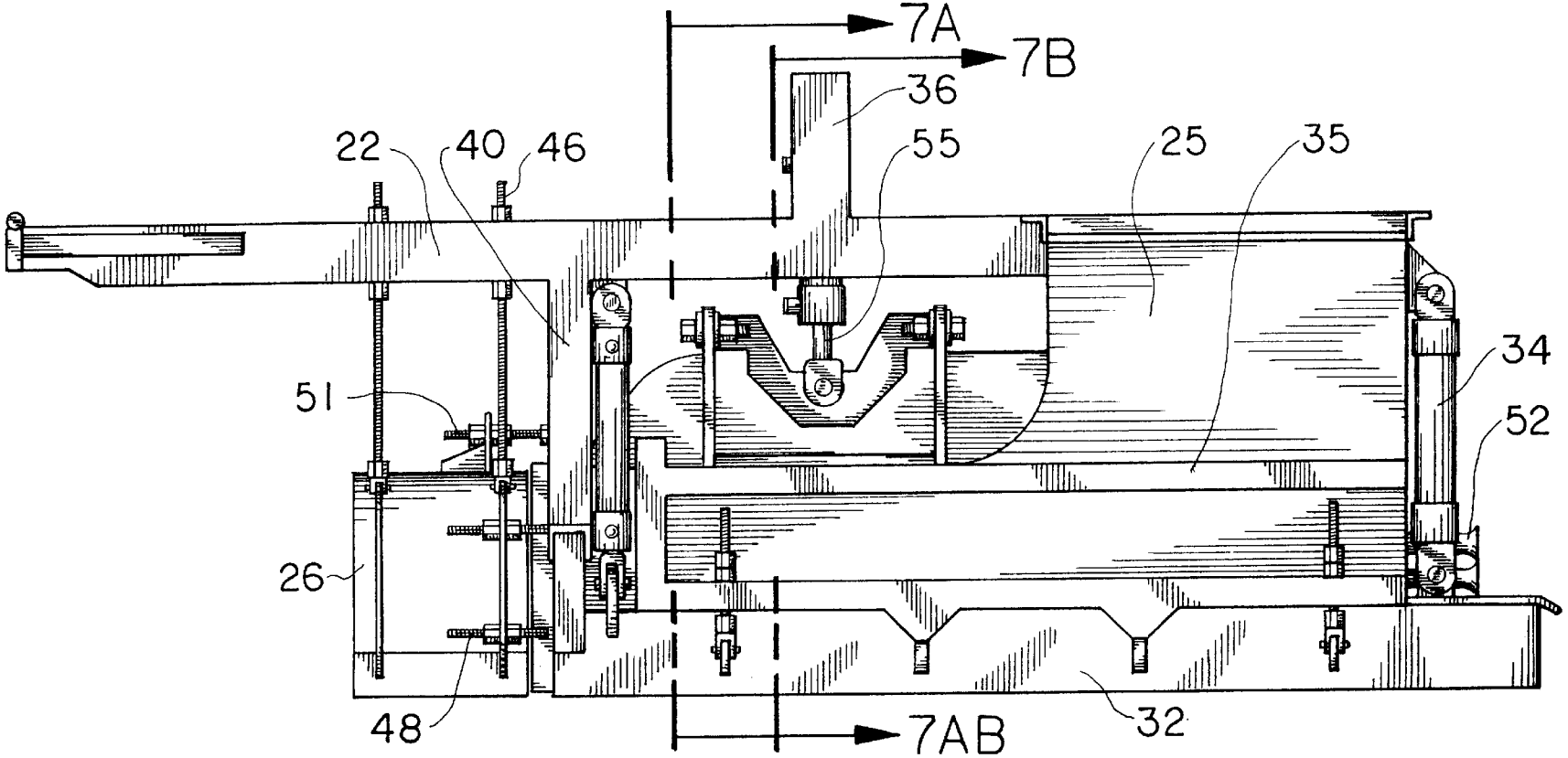
FIG. 3 is a side view, the front being at the right.

FIG. 3 shows a trowel piston 55 attached to the trowel cylinder 36. A horizontal reinforcement piece 35 protrudes from the mold frame 22 to sustain the extensible cutter 32. The vertical reinforcement 40 sustains the tension adjuster 51.

Figure 4:
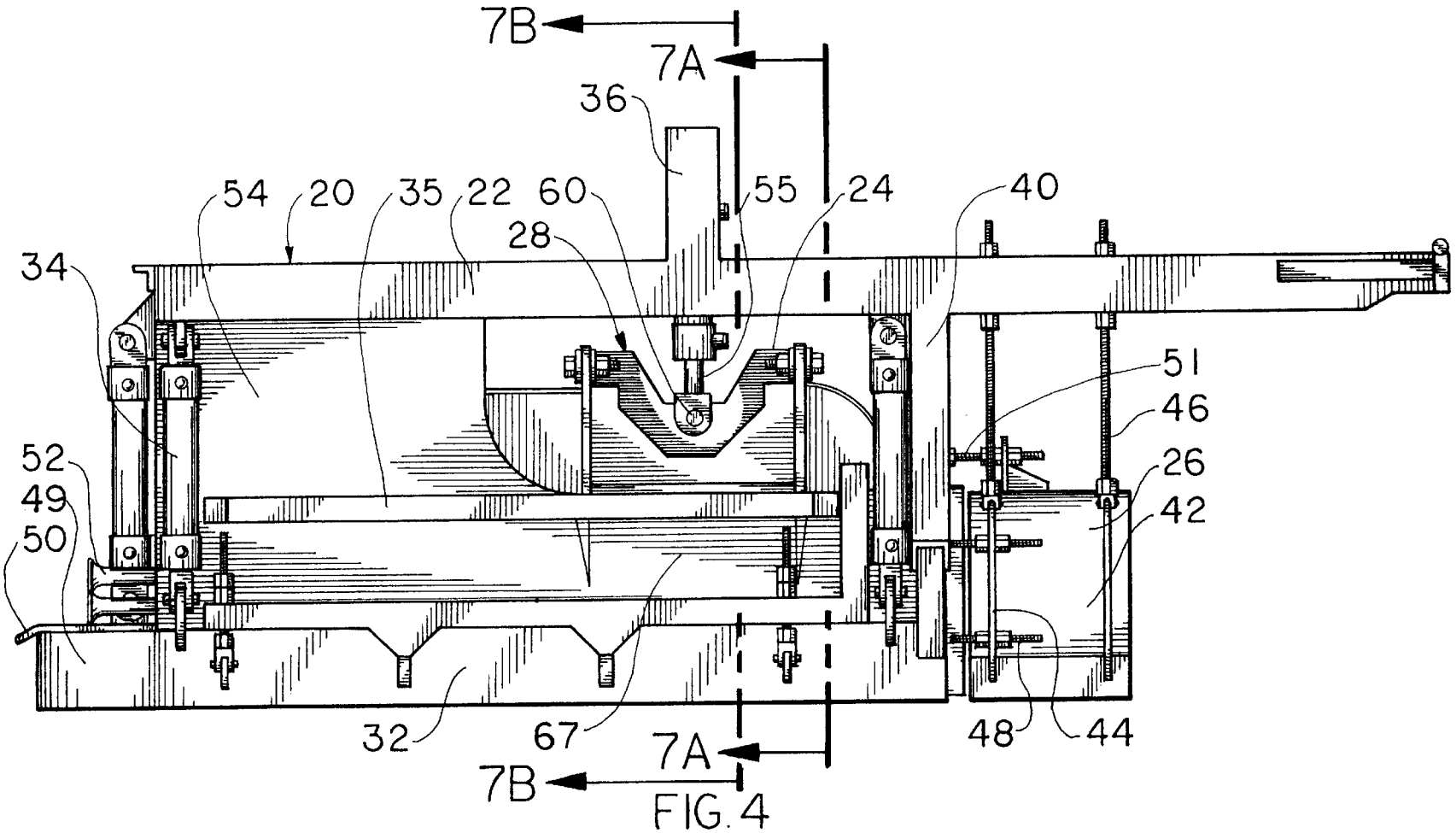
FIG. 4 is a side view, the front being at the left.

FIG. 4 shows a pivot 60 serving as a joint between the cutter 28 and the trowel piston 55. In the middle, under a cutter support 24 one sees an impression of an expansion room 67.

Figure 5:
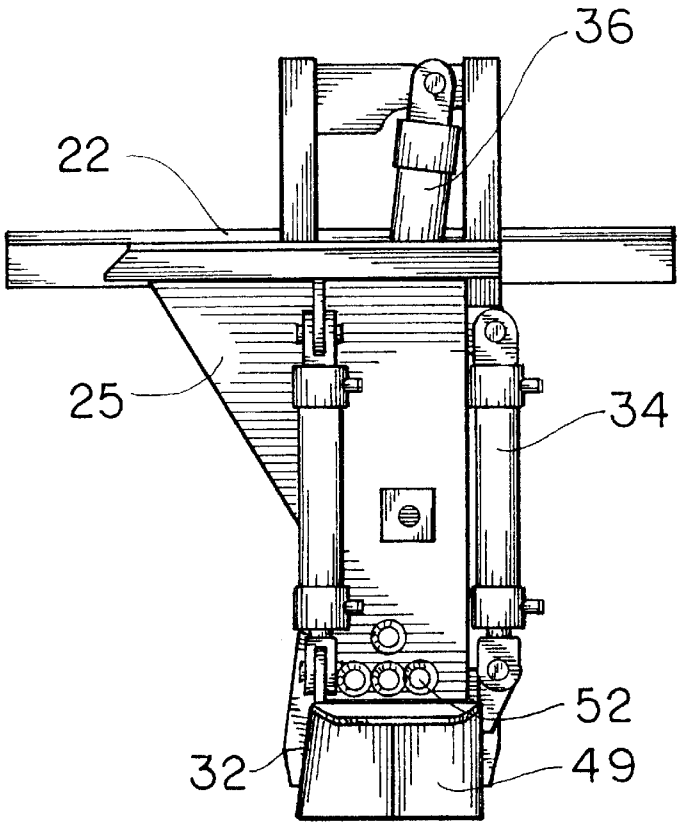
FIG. 5 is a front view.

FIG. 5 shows a mold frame 22, a bin 25, an extension cutter 32, a cutter cylinder 34, a trowel cylinder 36, a plow 49, a steel insertion tube 52.

Figure 6:
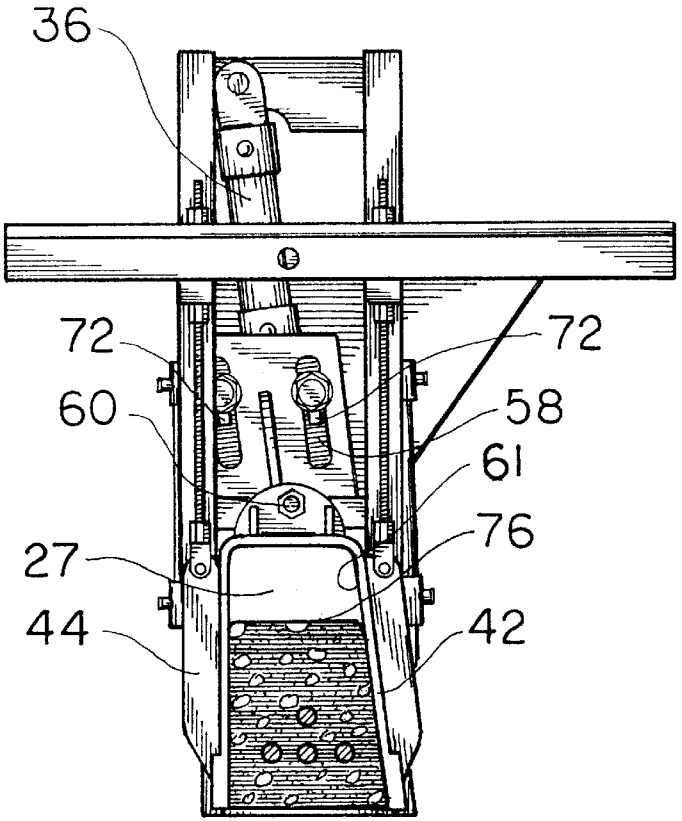
FIG. 6 is a back view.

FIG. 6 shows a guide slot 58 in which slides a rectangular barrier 72. One also sees an empty space 27 resulting from the path followed by the cutter 28 and resulting from the displacement of the trowel piston 55 inside the trowel cylinder 36.

Figure 7A:
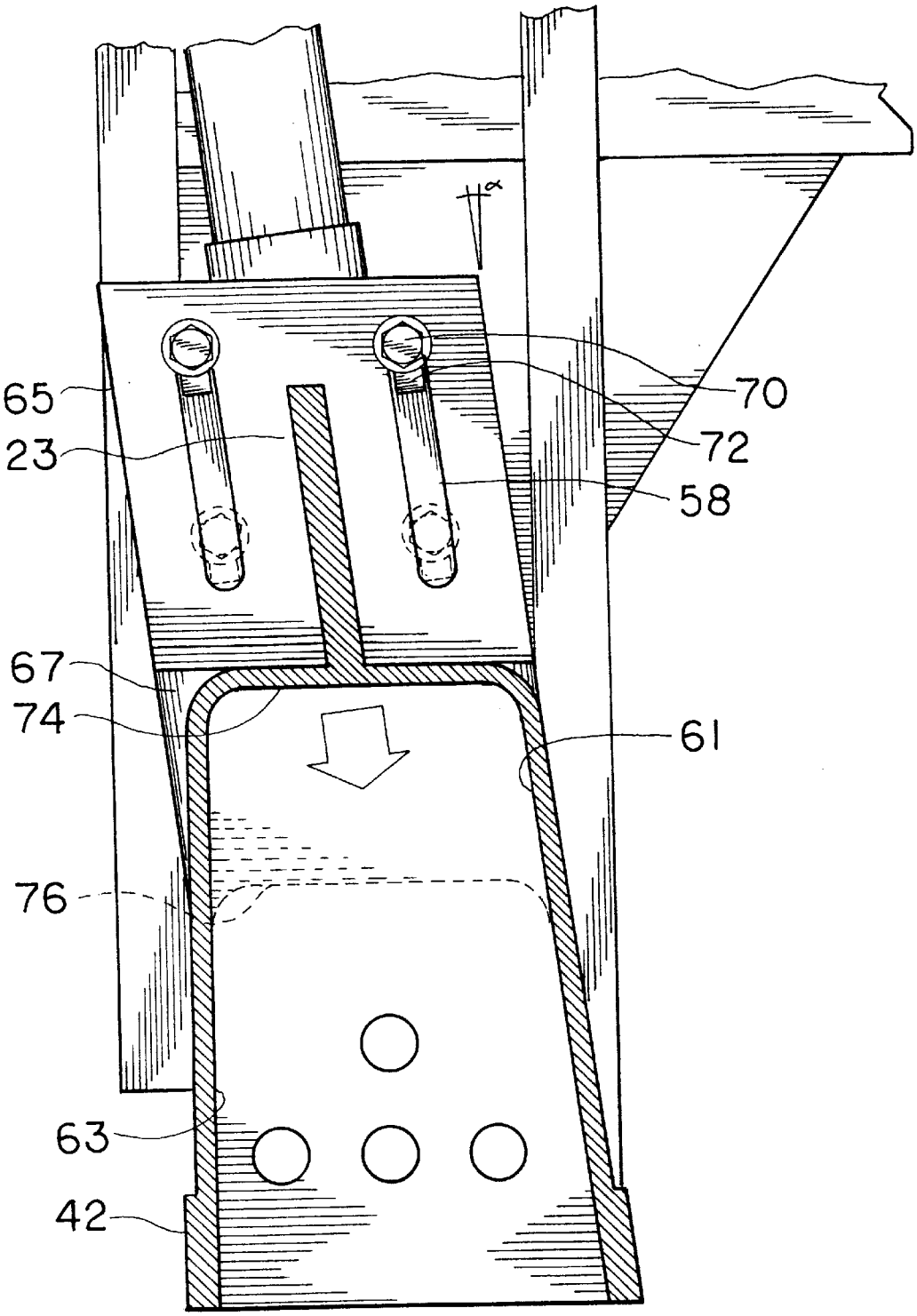
FIG. 7A is a cross-sectional view along line 7A—7A of FIG. 3.
Figure 7B:
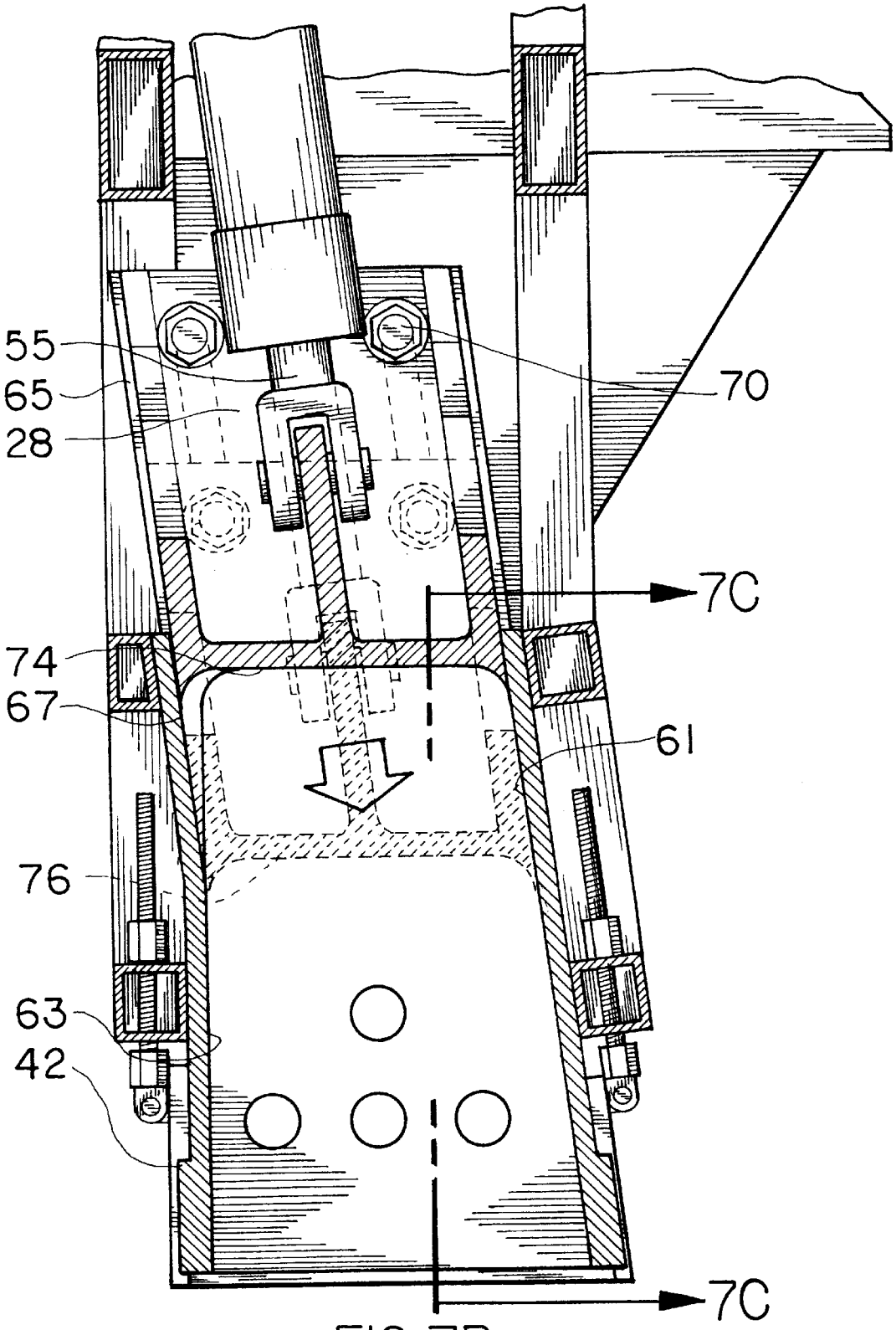
FIG. 7B is a cross-sectional view along line 7B—7B of FIG. 3.

FIGS. 7A and 7B show the two positions of the cutter 28, the raised position, corresponding to the top 74 and the lowered position, in dotted line, corresponding to an low level position 76, the movement being illustrated by an arrow. One also notices the guide slot of the bolt 70 attached to the rectangular barrier 72.

The cutter 28 moves along a wall 65 of the expansion room 67 from the top 74 to the low level position 76, according to an angle $\alpha$ corresponding to the slope of the slanted converging side 61 of the finishing shell 42. In the illustrated embodiment, the finishing shell 42 also has a other converging side 63.

Figure 7C:
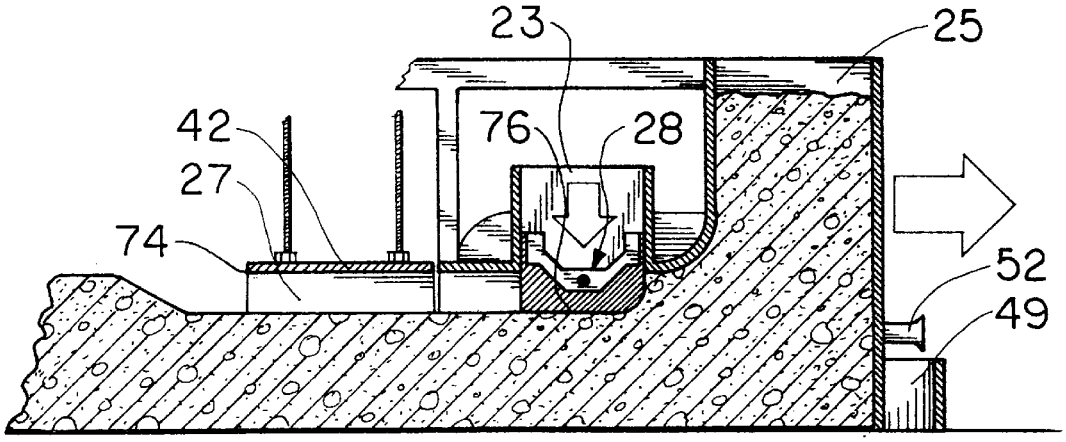
FIG. 7C is cut along line 7C—7C of FIG. 7B—7B of FIG. 7B.

FIG. 7C shows a trowel zone 23, a bin 25, an empty space 27, a cutter 28, a finisher shell 42, a plow 49, a steel insertion tube 40, a high level 74, a low level position 76.

Figure 8C:
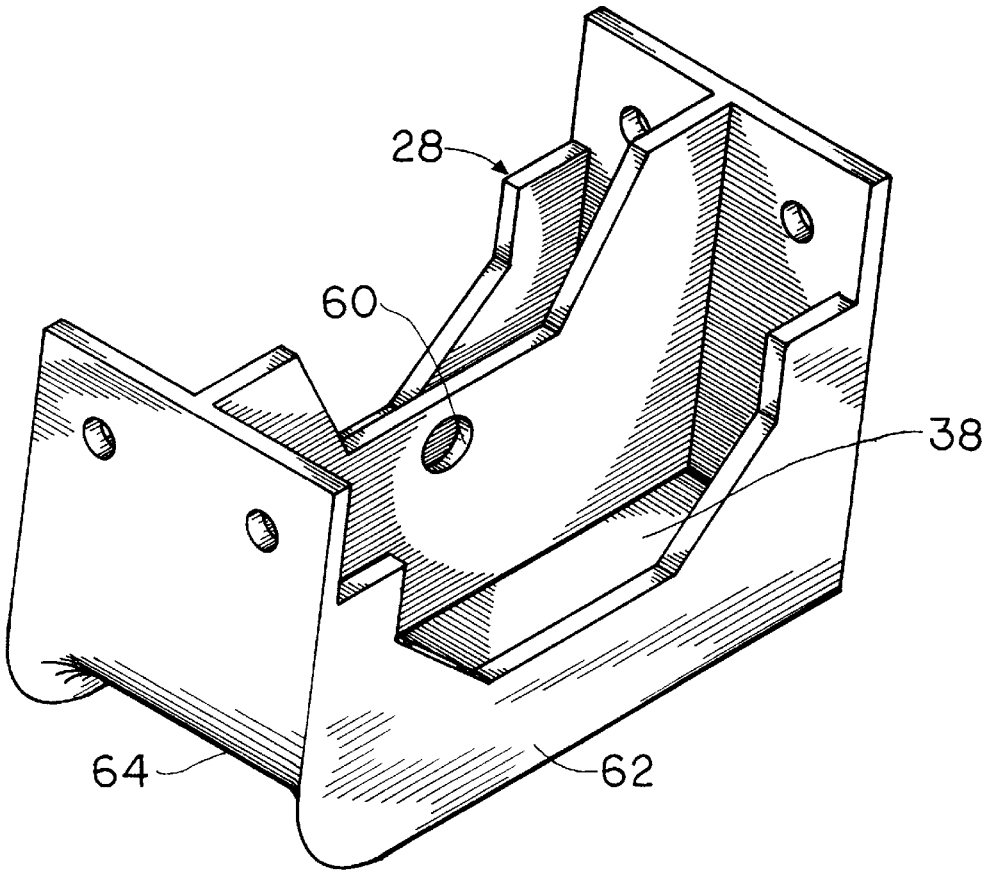
FIG. 8C is a perspective view of a cutter.
Figure 8B:
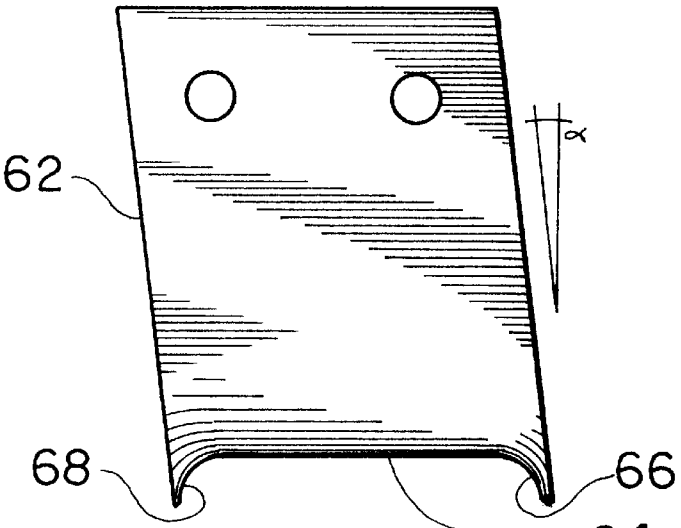
FIG. 8B is a back view of a cutter.
Figure 8A:
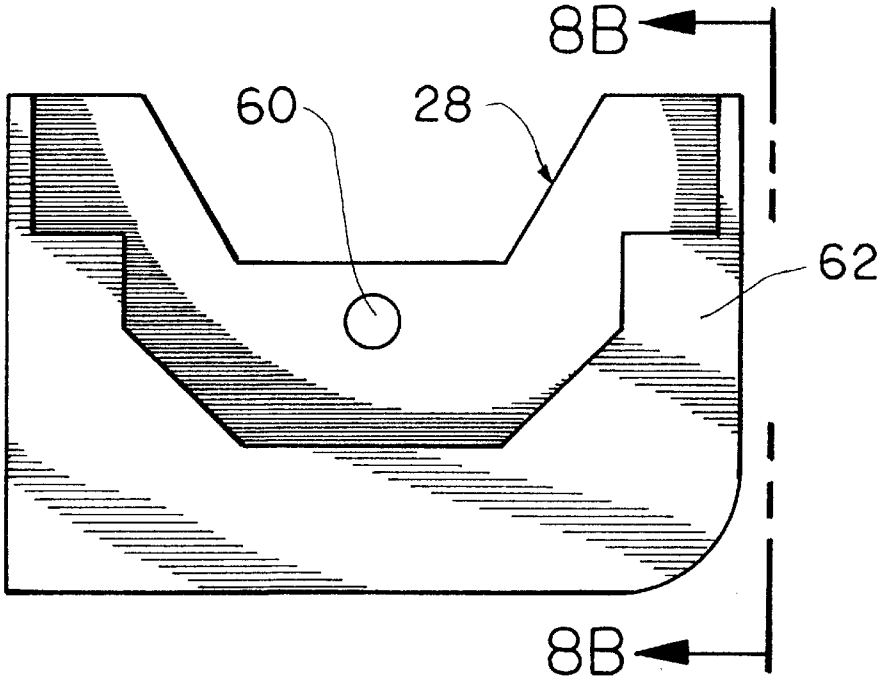
FIG. 8A is a side view of a cutter.

On FIG. 8A one notices a lateral plate 62 of the cutter 28.

On FIG. 8B the cutter 28 has a concave shape comprising an inner edge 66 that clings to the slanted converging side 61 and an outer edge—that joins the other converging side 63. The cutter 28 forms a parallelogram in which the higher and lower sides are horizontal and the higher sides are inclined according to the angle $\alpha$.

On FIG. 8C one sees a rounded concave form 64.

SUMMARY AND RAMIFICATIONS

An automated flexible trowel for sliding formwork machine including in combination:

a frame 22 including a front and a back and some reinforcement to support components, a bin 25 located on a frame front and allowing the flow of partially fluid material destined to fill up the formwork, a lateral support 35 on the frame including adjustable means of sustaining two lateral sides of formwork defining the extensible cutters 32, a finisher 26 adapted to define a section comprising the continuation of the two lateral sides, a high surface to a height corresponding to a top 74, the higher surface defining a higher line shorter than the intermediate distance between the two lateral sides, a cutter 28 adapted to lower the height to a low level position 76 of a horizontal surface defining an intermediate line longer than the higher line, the cutter 28 moving between a raised position corresponding to the higher line and a lowered position corresponding to an intermediate line, an expansion room 67 allowing the cutter 28 to partially take position when it is in the raised position or in a position higher than the intermediate position.

In the trowel 38 the two lateral sides may comprise a slanted converging side 61 and another converging side 63 which may be a vertical side; the cutter 28 may be of the shape close to the one of a parallelogram in which a side that is almost vertical is an acute angle, according with the horizontal and coinciding with the slanted converging side 61, and a bottom side that is horizontal and coinciding with the intermediate position, the side corresponding to the side that is almost vertical and the higher side meet in an apex, in a series of positions defining a wall 65 of the expansion room 67.

The trowel cutter 38 comprises, almost vertically, a lateral plate 62, and as bottom side a concave form 64 with an inner edge 66 clinging to the slanted converging side 61 and an outer edge 68 clinging to the other converging side 63. The concave form 64 possesses a rounded form in its contact point with the bin 25.

The trowel comprises a guide-slot 58, and a bolt 70 and a rectangular barrier 72 attached to the bolt 70; the cutter 28 moves according to the angle $\alpha$ corresponding to the slope of the slanted converging side 61 of the finishing shell 42.

The two lateral sides of the formwork comprise a pair of extensible cutters 32 mounted vertically and driven by the cutter cylinders 34 attached on the frame 22, or on the horizontal reinforcement piece 35 or on the vertical reinforcement 40 both attached on the frame 22.

The flexible automated trowel for the sliding formwork machine allows the finishing of the continuous trapezoidal wall of a type with one straight side and one angular side oriented upward or with two angular or straight sides. The mold carrying the trowel comprises two straight sides defining two (2) formwork lines, an enlarging setback originating from a formwork line. A driveway forming cutter is placed towards the slope or on a small slope and moves from the enlarging setback and follows the slope of the wall or a small slope. The cutter may be provided with a contact face of concave shape destined to produce an upper convex face to the continuous wall. Some materials like concrete for curbs and gutters and for house driveways may be continuously poured in and necessitate little or no finishing.

It is well intended that the embodiment of the present invention that has been described above, in referring to the annexed drawings is indicative only and by no means limiting, and that modifications and adaptations thereof may be brought without exceeding the object of the present invention.

Other embodiments are possible and only limited by the appended claims:

I claim:

1. A slip form comprising:

a frame (22)

a mold (20) supported by said frame (22) for movement along the ground, said mold (20) having a top (74), a front, a back and two converging sides (61,63) defining a trapezoidal section converging towards said top (74), one said converging side (61) being slanted relative to the ground;

a bin (25) secured to said frame (22) and communicating with said front of said mold for filling said mold with a partially fluid material, said top (74) having an opening intermediate said front and said back of said mold, a powered cutter (28) mounted to said frame (22) for movement through said opening between a top position coinciding with said top (74) and a low-level position (76) below said top (74) and said powered cutter being movable in a direction parallel to said slanted converging side (61), said other converging side (63) having a recessed upper section (67) parallel to said slanted side and upwardly extending from said low-level position, said powered cutter (28) being guided by and in scraping engagement with both said slanted side (61) and said recessed upper section (67).

2. The slip form of claim 1 wherein said other converging side (63) is perpendicular to the ground and wherein said powered cutter (28) has a parallelogram cross-section with cutter sides parallel to said recessed upper section (67) and to said slanted side (61) and with a horizontal bottom.

3. The slip form of claim 2 wherein said cutter (28) has a bottom comprising a concave form (64) with an inner edge (66) engaging with said slanted side (61) and an outer edge (68) engaging with said other converging side (63).

4. The slip form of claim 2 wherein said frame comprises a wall (65) having a guide slot (58), said cutter comprising a bolt (70) having a protruding rectangular barrier (72) engaging through said guide slot (58).

5. The slip form of claim 1 wherein said two converging sides of said mold comprise a pair of extensible cutters (32) mounted vertically and driven by cutter cylinders (34) mounted on said frame (22).

* * * * *